US006500270B2

(12) United States Patent
Nohara et al.

(10) Patent No.: US 6,500,270 B2
(45) Date of Patent: Dec. 31, 2002

(54) RESIST FILM REMOVING COMPOSITION AND METHOD FOR MANUFACTURING THIN FILM CIRCUIT ELEMENT USING THE COMPOSITION

(75) Inventors: Masahiro Nohara, Mie-ken (JP); Yukihiko Takeuchi, Mie-ken (JP); Taimi Oketani, Mie-ken (JP); Taketo Maruyama, Niigata-ken (JP); Tetsuya Karita, Niigata-ken (JP); Hisaki Abe, Niigata-ken (JP); Tetsuo Aoyama, Niigata-ken (JP)

(73) Assignees: Sharp Corporation, Osaka (JP); Mitsubishi Gas Chemical Company, Inc., Tokyo (JP)

( * ) Notice: Subject to any disclaimer, the term of this patent is extended or adjusted under 35 U.S.C. 154(b) by 0 days.

(21) Appl. No.: 09/176,523

(22) Filed: Oct. 21, 1998

(65) Prior Publication Data

US 2001/0013502 A1 Aug. 16, 2001

(30) Foreign Application Priority Data

Oct. 28, 1997 (JP) ..... 9-295250

(51) Int. Cl.[7] ..... C23G 1/00

(52) U.S. Cl. ..... 134/2; 134/1; 134/3; 134/6; 134/9; 134/28; 134/29; 134/30; 510/108; 510/201

(58) Field of Search ..... 134/2, 38, 1, 3, 134/6, 9, 28, 29, 30; 510/178

(56) References Cited

U.S. PATENT DOCUMENTS

| | | | | | |
|---|---|---|---|---|---|
| 4,276,186 | A | * | 6/1981 | Bakos et al. | 252/158 |
| 4,770,713 | A | * | 9/1988 | Ward | 134/38 |
| 4,786,578 | A | * | 11/1988 | Neisius et al. | 430/256 |
| 5,561,105 | A | * | 10/1996 | Honda | 510/178 |
| 5,665,688 | A | * | 9/1997 | Honda et al. | 510/178 |

FOREIGN PATENT DOCUMENTS

| | | | | | |
|---|---|---|---|---|---|
| JP | 408123043 | A | * | 5/1996 | G03F/7/42 |

* cited by examiner

*Primary Examiner*—Randy Gulakowski
*Assistant Examiner*—M. Kornakov
(74) *Attorney, Agent, or Firm*—Frishauf, Holtz, Goodman & Chick, P.C.

(57) ABSTRACT

A resist film removing composition used in the manufacture of a thin film circuit element having an organic insulation film which comprises 50 to 70% by weight of an alkanolamine having 3 or more carbon atoms, 20 to 30% by weight of a water-miscible solvent and 10 to 20% by weight of water. The resist film removing composition can easily remove a resist film remaining after etching, without swelling the organic insulation film.

13 Claims, 1 Drawing Sheet

RESIST FILM REMOVING COMPOSITION AND METHOD FOR MANUFACTURING THIN FILM CIRCUIT ELEMENT USING THE COMPOSITION

FIELD OF THE INVENTION

The present invention relates to a resist film removing composition and a method for manufacturing a thin film circuit element using the composition. More particularly the present invention relates to a resist film removing composition used for manufacturing a thin film circuit element having an organic insulation film, the resist film removing composition being capable of easily removing the resist film remaining after etching in a short time without swelling the organic insulation film, and a method for manufacturing a high quality thin film circuit element having an organic insulation film using the composition.

DESCRIPTION OF RELATED ARTS

Electronic circuit devices such as a liquid crystal display device and a semiconductor device are generally manufactured by forming a thin film on a substrate by utilizing a sputtering technique, applying a resist thereon to form a resist film, forming a predetermined resist pattern by, for example, a photolithography, etching a non-masked area using the resist pattern as a mask to form a circuit and removing the resist film remaining thereon. In particular, in the case that pixel electrodes are formed with Indium Tin Oxide (ITO), the substrate on which the resist film is formed is generally wet etched using an aqueous solution containing aqua regia, or hydrochloric acid and ferric chloride and then the resist film is removed using a resist film removing liquid. However, if an organic insulation film comprising an acrylic resin, a polyimide resin or the like exists upon a removal of the resist film, a conventional resist film removing liquid (disclosed in Japanese Patent Application Laid-Open No. Hei 8(1996)-123043) swells the organic insulation film, resulting in a problem that the organic insulation layer is not closely contacted with an orientation layer in a subsequent step.

Accordingly, upon forming a thin film pattern such as a liquid crystal display device and a semiconductor device, it has been desired to develop a resist film removing composition that can remove easily the resist film remaining after etching without swelling the organic insulation film comprising an acrylic resin or a polyimide resin, if it exists.

SUMMARY OF THE INVENTION

An object of the present invention is to provide a resist film removing composition used for manufacturing a thin film circuit element having an organic insulation film, the composition being capable of removing a resist layer film remaining after etching easily in a short time without swelling the organic insulation film and to provide a method for manufacturing a high quality thin film circuit element having an organic insulation film using the composition.

Through intense studies to attain the object mentioned above, the present inventors found that a resist film removing composition comprising an alkanolamine having 3 or more carbon atoms, a water-miscible solvent and water in a specific ratio can meet the object. The present invention has been accomplished based on such discoveries.

Accordingly, the present invention provides (1) a resist film removing composition used for manufacturing a thin film circuit element having an organic insulation film, comprising 50 to 90% by weight of an alkanolamine having 3 or more carbon atoms, 8 to 40% by weight of a water-miscible solvent and 2 to 30% by weight of water and (2) a method for manufacturing a thin film circuit element having an organic insulation film, comprising the step of removing a resist film remaining after etching by using the resist film removing composition.

DETAILED DESCRIPTION OF THE INVENTION

Figure 1:
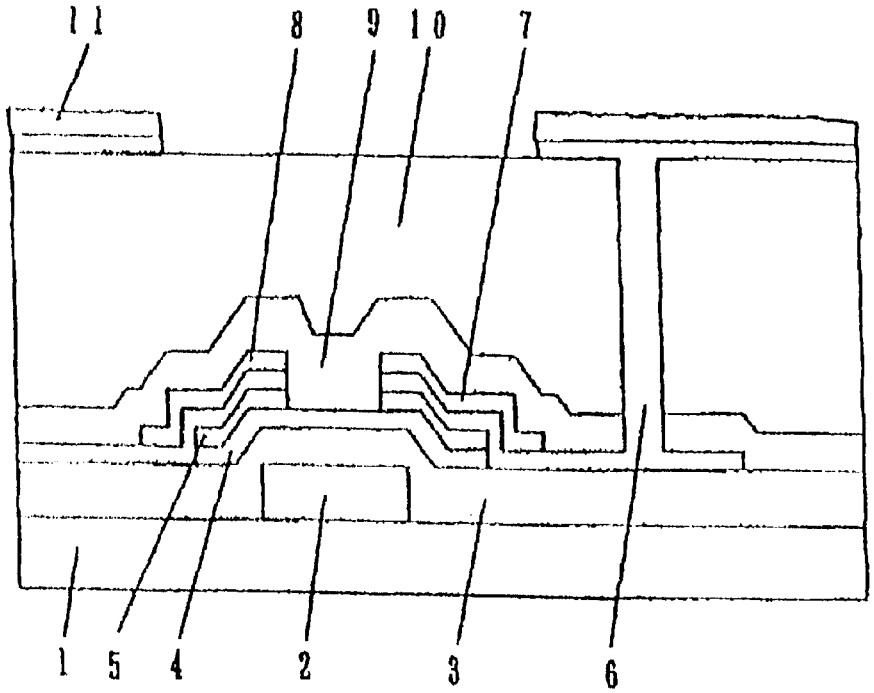
FIG. 1 is a sectional view of a thin film circuit element having a resist film remaining after etching used in Examples and Comparative Examples.

Examples of an alkanolamine having 3 or more carbon atoms used in the removing composition of the present invention include at least one selected from the compounds represented by, for example, the formula (I)

$$R^1{}_mH_{2-m}NC_nH_{2n}OH \quad (I)$$

wherein $R^1$ is an alkyl group having 1 to 4 carbon atoms, m is an integer of 0, 1 or 2, n is an integer of 1 to 4 with the provisos that the integers are selected so that the sum of the carbon atoms are 3 or more, and each $R^1$ may be same or different when two $R^1$ exist and the formula (II)

$$R^2{}_kH_{2-k}NC_pH_{2p}OC_qH_{2q}OH \quad (II)$$

wherein $R^2$ is an alkyl group having 1 to 4 carbon atoms, k is an integer of 0, 1 or 2, p and q are integers of 1 to 4 with the provisos that the integers are selected so that the sum of the carbon atoms are 3 or more, and each $R^2$ may be same or different when two $R^2$ exist.

Examples of the compound represented by the formula (I) include 1-amino-2-propanol (monoisopropanolamine); 3-amino-1-propanol; 2-amino-1-propanol; N-methylethanolamine; N,N-dimethylethanolamine; N-ethylethanolamine; N,N-diethylethanolamine; N-methylpropanolamine; N,N-dimethylpropanolamine; N-ethylpropanolamine, and examples of the compound represented by the formula (II) include 2-(2-aminoethoxy) ethanol; 2-(2-aminoethoxy)propanol. Among them, 1-amino-2-propanol(monoisopropanolamine); N-methylethanolamine; N,N-dimethylethanolamine; N,N-diethylethanolamine; N-ethylethanolamine; and 2-(2-aminoethoxy)ethanol are especially preferred. These alkanolamines may be used alone or in combination.

A content of the alkanolamine having 3 or more carbon atoms used in the resist film removing composition of the present invention is selected in the range of 50 to 90% by weight. If the content is less than 50% by weight, a speed of removing the resist film remaining after etching is too late for a practical use. If the content exceeds 90% by weight, swelling of the organic insulation film is not effectively prevented. In view of the removing speed of the resist film and the effective prevention of the organic insulation film swelling, the content of the alkanolamine is preferably in the range of 60 to 80% by weight.

Examples of a water-miscible solvent used in the resist film removing composition of the present invention include alcohols such as methanol, ethanol, isopropanol, ethyleneglycol and glycerin; amides such as formamide, N-methylformamide, N,N-dimethylformamide, N,N-dimethylacetamide and N-methylpyrrolidone; lactones such as γ-butyrolactone; esters such as methyl lactate and ethyl lactate; nitriles such as acetonitrile; ethers such as ethylene glycol monomethyl ether, ethylene glycol monoethyl ether, diethylene glycol monomethyl ether, diethylene glycol monoethyl ether, diethylene glycol monobutyl ether and triethylene glycol monomethyl ether; sulforanes such as sulforane; sulfoxides such as dimethylsulfoxide or the like. Other than these organic solvents, compounds having a functional group of the above-cited compounds such as sugars, polyols typified by sugar alcohols and urea can be used. Among them, diethylene glycol monomethyl ether, diethylene glycol monoethyl ether, diethylene glycol monobutyl ether, N-methylpyrrolidone and dimethylsulfoxide are suitably used. These water-miscible solvents may be used alone or in combination.

A content of the water-miscible solvent in the resist film removing composition of the present invention is selected in the range from 8 to 40% by weight. If the content of the water-miscible solvent is less than 8% by weight, a speed of removing the resist film remaining after etching is too late for a practical use. If the content exceeds 40% by weight, swelling of the organic insulation film is not effectively prevented. In view of the removing speed of the resist film and the effective prevention of the organic insulation film swelling, the content of the water-miscible solvent is preferably in the range of 15 to 35% by weight.

A content of water in the resist film removing composition of the present invention is selected in the range of 2 to 30% by weight. If the content of water is less than 2% by weight, swelling of the organic insulation film is not effectively prevented. If the content exceeds 30% by weight, removability of the resist film remaining after etching is decreased. In view of the effective prevention of the organic insulation film swelling and the removability of the resist film, the content of water is preferably in the range of 5 to 25% by weight. Water used is preferably ion-exchanged pure water, more preferably ultrapure water passed through a reverse osmosis membrane.

A preparation method of the resist film removing composition of the present invention is not especially limited. For example, the alkanolamine, the water-miscible solvent and water are fed to a mixer equipped with a simple agitator in a predetermined ratio and agitated at room temperature to obtain a homogeneous solution, which is then filtered through a membrane filter having a pore diameter of approximately 0.2 μm or less as required. Thus, the known method is used to prepare the resist film removing composition of the present invention.

The resultant resist film removing composition can remove a resist film easily in a short time; the resist film being a resist film post-baked at ordinary temperature, a resist film post-baked at an elevated temperature or a resist film modified by etching. The organic insulation film, even if it exists, is never altered, i.e., never swelled. The resist film removing composition of the present invention is used for a manufacture of the thin film circuit element having an organic insulation film, preferably used for a manufacture of the thin film circuit element having the organic insulation film formed by photolithography. Most preferably, the resist film removing composition of the present invention is applied to a manufacture of a thin film circuit element having an organic insulation film comprising an acrylic resin or a polyimide resin.

The method for manufacturing the thin film circuit element according to the present invention will be described.

On a substrate on which the organic insulation film is formed, a thin film such as ITO, aluminum, silicon nitride, Ga—As, copper, chromium oxide, nickel, chromium, indium or titanium oxide is deposited by sputtering or vacuum deposition. A resist film is then deposited thereon. The resist film is exposed to activating light for forming an image and is developed to form a predetermined resist pattern on the thin film. The resist pattern is used as a mask to etch a non-masked area by a known etching method. The remaining resist film is removed using the resist removing composition of the present invention.

Examples of the method for removing the resist film by the resist film removing composition include a method for immersing the substrate in the resist film removing composition, a method for immersing the substrate in the resist film removing composition and for agitating the resist film removing composition with ultrasonic vibration or an agitating blade, and a method for spraying the resist film removing composition to the substrate. A temperature of the resist film removing composition may be an arbitrary temperature ranging from room temperature to the boiling point, preferably 30 to 90° C., more preferably 40 to 80° C. A removing time is not especially limited and is selected as appropriate depending on the removing method and the temperature of the resist film removing composition.

After the resist film remaining is thus removed using the resist film removing composition, the substrate is rinsed with water to remove the resist film completely, thereby affording the desired thin film circuit element having the organic insulation film.

In the rinsing step, a solution containing inorganic acids such as sulfuric acid, hydrochloric acid, phosphoric acid, hydrofluoric acid, acidic ammonium fluoride; and organic acids such as formic acid, acetic acid, propionic acid, oxalic acid, malonic acid and adipic acid is used before washing with water as required. The washing with the solution containing any of the acids may be conducted at an arbitrary temperature ranging from room temperature to the boiling point, preferably 30 to 90° C., more preferably 40 to 80° C. A washing time is not especially limited and is selected as appropriate depending on types and concentration of the acids and the temperature.

Examples of the substrate include a semiconductor substrate such as a silicon wafer and a Ga—As wafer for manufacturing a semiconductor device and a glass substrate for manufacturing a liquid crystal display device.

The resist film removing composition of the present invention can remove the resist film remaining after the etching easily in a short time without causing alteration such as swelling of the organic insulation film in a manufacture of the thin film circuit element having the organic insulation film comprising the acrylic resin or the polyimide resin, thus is favorably used for a manufacture of the liquid crystal display device and the semiconductor device.

Examples of the present invention and comparative examples are given below by way of illustration of the present invention, and are not in any way designed to limit its scope.

Figure 2:
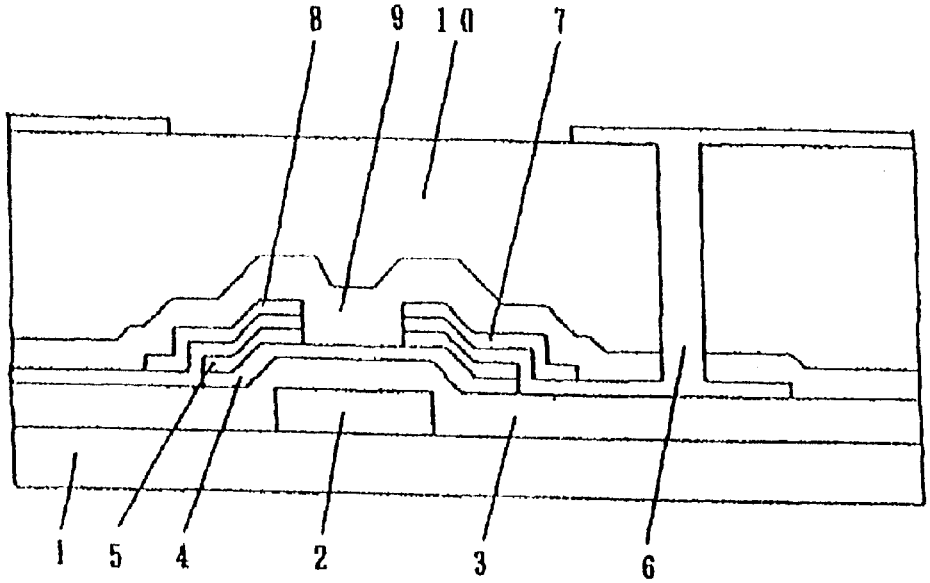
FIG. 2 is a sectional view of the thin film circuit element of FIG. 1 in which the resist film is removed.

FIG. 1 is a sectional view of a thin film circuit element having a resist film remaining after etching used in Examples and Comparative Examples, and FIG. 2 is a sectional view of the thin film circuit element of FIG. 1 in which the resist film is removed.

In FIG. 1, a gate electrode 2, an insulation film 3, a semiconductor layer 4, a contact layer 5 and a source electrode 7 and a drain electrode 8 are sequentially formed on a glass substrate 1. A passivation film (I) 9 is formed on the source electrode 7 and the drain electrode 8, and a passivation film (II) 10 is formed on the passivation film (I) 9. A pixel electrode 6, i.e., ITO is deposited on the passivation film (II) 10 and a resist film 11 is formed on the ITO. A resist pattern (not shown) is formed on the resist film 11 by photolithography and the resist film is wet-etched with a solution containing hydrochloric acid and ferric chloride. FIG. 2 shows a clean thin film circuit element in which the remaining resist film is removed using the resist film removing composition after the wet-etching.

EXAMPLES 1 to 7 and COMPARATIVE EXAMPLES 1 to 6

The thin film circuit element having the resist film shown in FIG. 1 was immersed in the resist film removing compositions shown in Table 1-1 under conditions shown in Table 1–2, rinsed with ultrapure water and dried to obtain the thin film circuit element where the resist film shown in FIG. 2 was removed. The resultant thin film circuit element was observed using a scanning electron microscope (SEM) to test and determine removability of the resist film 11 and swelling property of the passivation film (insulation film) 10 composed of an acrylic resin in accordance with the following criteria. The results are shown in Table 1-2.

(1) Removability of the Resist Film

⊙: completely removed

Δ: partly remained

×: mostly remained (2) Swelling Property of the Insulation Film

⊙: never swelled

Δ: partly swelled

×: severely swelled

TABLE 1-1

| | Resist film removing composition | | | | |
|---|---|---|---|---|---|
| | Alkanolamine | | Water-miscible solvent | | Water content |
| | Type | Content (% by weight) | Type | Content (% by weight) | (% by weight) |
| E1 | MIPA | 60 | DEGMME | 30 | 10 |
| E2 | MIPA | 60 | Dimethyl sulfoxide | 30 | 10 |
| E3 | MIPA | 60 | N-methyl pyrrolidone | 30 | 10 |
| E4 | MIPA | 70 | DEGMBE | 20 | 10 |
| E5 | DEEA | 60 | DEGMME | 30 | 10 |
| E6 | DMEA | 60 | DEGMME | 30 | 10 |
| E7 | MIPA | 50 | DEGMME | 30 | 20 |
| CE1 | MIPA | 60 | — | — | 40 |
| CE2 | — | — | DEGMME | 30 | 70 |
| CE3 | MEA | 70 | Dimethyl sulfoxide | 30 | — |
| CE4 | MIPA | 40 | DEGMME | 30 | 30 |
| CE5 | MIPA | 70 | DEGMME | 5 | 25 |
| CE6 | MIPA | 50 | DEGMME | 45 | 5 |

E: Example
CE: Comparative Example
MIPA: Monoisopropanolamine
DEEA: Diethylethanolamine
DMEA: Dimethylethanolamine
MEA: Monoethanolamine
DEGMME: Diethylene glycol monomethyl ether
DEGMBE: Diethylene glycol monobutyl ether

TABLE 1-2

| | Immersion conditions | | Evaluation | |
|---|---|---|---|---|
| | Temperature (° C.) | Time (min) | Removability of the resist film | Swelling property of the insulation film |
| E1 | 60 | 10 | ⊙ | ⊙ |
| E2 | 60 | 10 | ⊙ | ⊙ |
| E3 | 60 | 10 | ⊙ | ⊙ |
| E4 | 60 | 10 | ⊙ | ⊙ |
| E5 | 70 | 10 | ⊙ | ⊙ |
| E6 | 70 | 10 | ⊙ | ⊙ |
| E7 | 70 | 10 | ⊙ | ⊙ |
| CE1 | 60 | 10 | Δ | Δ |
| CE2 | 60 | 10 | X | ⊙ |
| CE3 | 60 | 10 | ⊙ | X |
| CE4 | 60 | 10 | X | ⊙ |
| CE5 | 60 | 10 | ⊙ | X |
| CE6 | 60 | 10 | Δ | Δ |

E: Example
CE: Comparative Example

What is claimed is:

1. A resist film removing composition used for manufacturing a thin film circuit element having an organic insulation film consisting essentially of 50 to 70% by weight of an alkanolamine selected from the group consisting of 1-amino-2-propanol, N,N-diethylethanolamine and N,N-dimethylethanolamine, 20 to 30% by weight of a water-miscible solvent selected from the group consisting of diethylene glycol monomethyl ether, diethylene glycol monobutyl ether, dimethyl sulfoxide and N-methylpyrrolidone and 10 to 20% by weight of water.

2. The resist film removing composition according to claim 1, wherein the organic insulation film comprises an acrylic resin or a polyimide resin.

3. A method for manufacturing a thin film circuit element having an organic insulation film formed on a substrate, comprising:

depositing a thin film on the organic insulating film, depositing a resist film on the thin film, forming a resist pattern as a mask on the thin film, etching a non-masked area of the thin film and contacting the resultant thin film circuit element with the resist film removing composition of claim 1 to remove resist film remaining after the etching.

4. A method for manufacturing a thin film circuit element having an organic insulation film formed on a substrate, comprising:

depositing a thin film on the organic insulating film, depositing a resist film on the thin film, forming a resist pattern as a mask on the thin film, etching a non-masked area of the thin film and contacting the resultant thin film circuit element with the resist film removing composition of claim 2 to remove resist film remaining after the etching.

5. The resist film removing composition according to claim 1, wherein the watermiscible solvent is selected from the group consisting of diethylene glycol monomethyl ether, dimethylsulfoxide and N-methylpyrrolidone.

6. The method according to claim 3, wherein the substrate is selected from the group consisting of a silicon wafer and a Ga—As wafer.

7. The method according to claim 6, wherein the thin film is selected from the group consisting of ITO, aluminum, silicon nitride, Ga—As, copper, chromium oxide, nickel, chromium, indium and titanium oxide.

8. The method according to claim 7, wherein the organic insulating film is selected from the group consisting of an acrylic resin and a polyimide resin.

9. The resist film removing composition according to claim 1, wherein the alkanolamine is 1-amino-2-propanol and the water-miscible solvent is dimethylsulfoxide.

10. The resist film removing composition according to claim 1, wherein the alkanolamine is 1-amino-2-propanol and the water-miscible solvent is N-methylpyrrolidone.

11. The resist film removing composition according to claim 1, wherein the alkanolamine is 1-amino-2-propanol and the water-miscible solvent is diethylene glycol monomethyl ether.

12. The resist film removing composition according to claim 1, wherein the alkanolamine is N,N-diethylethanolamine and the water-miscible solvent is diethylene glycol monomethyl ether.

13. The resist film removing composition according to claim 1, wherein the alkanolamine is N,N-dimethylethanolamine and the water-miscible solvent is diethylene glycol monomethyl ether.

* * * * *